US010676876B1

(12) United States Patent
Mershimer

(10) Patent No.: US 10,676,876 B1
(45) Date of Patent: Jun. 9, 2020

(54) METHOD AND BRICK CONFIGURATION FOR SPORTS FIELD CONSTRUCTION

(71) Applicant: Kurt P. Mershimer, Volant, PA (US)

(72) Inventor: Kurt P. Mershimer, Volant, PA (US)

(73) Assignee: DuraEdge Products, Inc., Grove City, PA (US)

( * ) Notice: Subject to any disclaimer, the term of this patent is extended or adjusted under 35 U.S.C. 154(b) by 0 days.

(21) Appl. No.: 16/226,923

(22) Filed: Dec. 20, 2018

(51) Int. Cl.
*E01C 13/02* (2006.01)
*E01C 19/48* (2006.01)

(52) U.S. Cl.
CPC ..... *E01C 13/02* (2013.01); *E01C 19/48* (2013.01)

(58) Field of Classification Search
CPC ..... E01C 13/02; E01C 19/48
USPC ..... 404/17, 27–29, 31, 34–36, 72, 75
See application file for complete search history.

(56) References Cited

U.S. PATENT DOCUMENTS

| | | | | |
|---|---|---|---|---|
| 1,594 | A * | 5/1840 | Russell | E01C 5/14 404/46 |
| 162,218 | A * | 4/1875 | Carr et al. | E01C 5/14 404/46 |
| 1,028,703 | A * | 6/1912 | Fulton | E04F 15/04 52/313 |
| 1,464,423 | A | 8/1923 | Hardoncourt, Jr. | |
| 4,523,755 | A * | 6/1985 | Turba | C04B 28/04 106/720 |
| 9,267,260 | B2 | 2/2016 | MacDonald et al. | |
| 9,464,434 | B2 | 10/2016 | MacDonald et al. | |
| 2004/0156680 | A1 | 8/2004 | Gibbs | |

* cited by examiner

*Primary Examiner* — Raymond W Addie
(74) *Attorney, Agent, or Firm* — Harpman & Harpman

(57) ABSTRACT

A method and clay brick configuration for use in sports field construction having a generally rectangular paver like configuration with spaced parallel flat upper and lower surface portions with angular inclined spaced parallel side surfaces. Oppositely disposed substantially vertical end surfaces define the brick's overall length. The clay brick provides for interlocking surface to surface engagement during field construction and compaction in vertical and horizontal brick surface adjacent engagement placement.

7 Claims, 4 Drawing Sheets

METHOD AND BRICK CONFIGURATION FOR SPORTS FIELD CONSTRUCTION

BACKGROUND OF THE INVENTION

1. Technical Field

This invention relates to sports field construction in which playing surfaces are formed by compaction of soil, specifically clay based materials to form specific sports field surface contours.

2. Description of Prior Art

Prior art playing field construction utilizes a variety of surface material build-up for durability and usability, typically using common preformed clay bricks that are layered in side by side relation to form a sub-base of varying densities depending on the field position requirements. Examples of alternate brick in building block configurations can be seen in U.S. Pat. Nos. 9,267,260, 9,464,434. Also see U.S. Publication 2004/0156680.

In U.S. Pat. No. 9,267,260 a construction block is illustrated having multiple diverging angled surfaces and slotted openings to afford interlocking configuration.

U.S. Pat. No. 9,464,434 discloses a block with twisted angled sides and wall surfaces for tangential engagement.

U.S. Pat. No. 1,464,423 claims a clay shingle block and wall construction having oppositely opposing tapered surfaces and upstanding integrated flanges for interlocking engagement.

In U.S. Publication 2004/0156680 shows a beach stabilization block having tapered sides with interlocking apertured dove tailed ends.

SUMMARY OF THE INVENTION

A method and apparatus for sports field construction utilizing multiple clay bricks having parallel spaced elongated sides and top and bottom surfaces supporting horizontal or vertical side by side overlapping block layer engagement. The method steps are inclusive of positional brick engagement for forced compaction transfer there between defining a monolithic compact glaze support layer for field construction applications in the sports field surfaces and shapes.

DETAILED DESCRIPTION OF THE INVENTION

Figure 1:
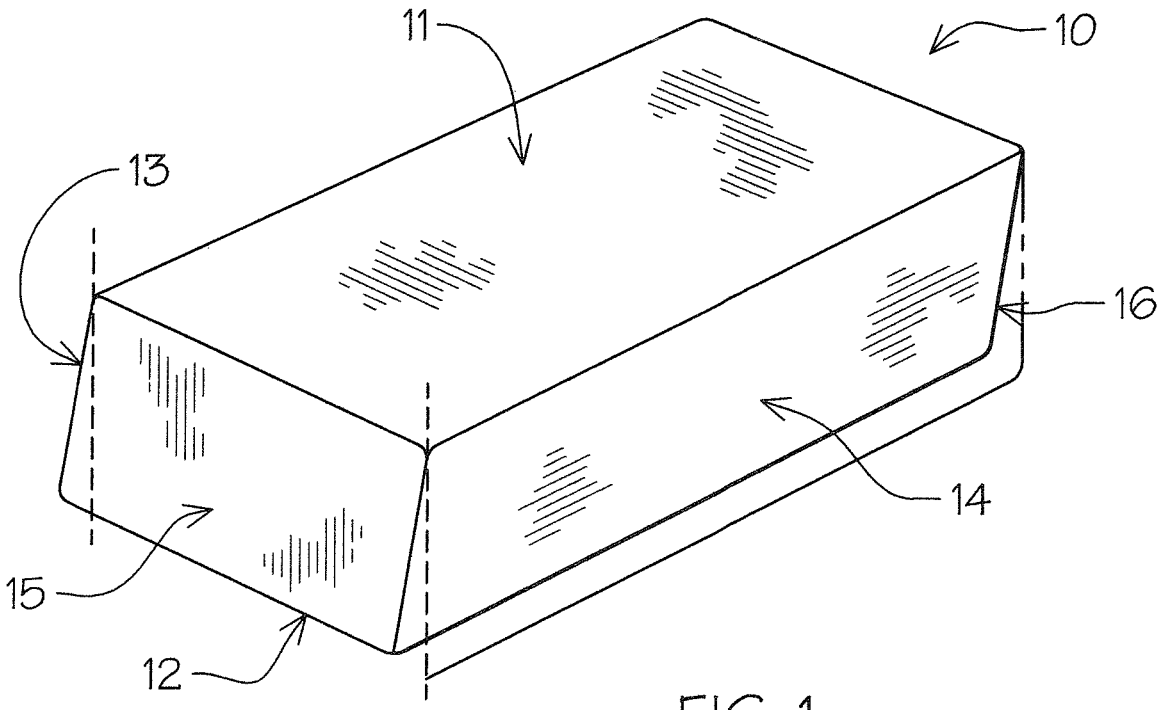
FIG. 1 is a perspective view of a clay brick of the method of the invention.
Figure 2:
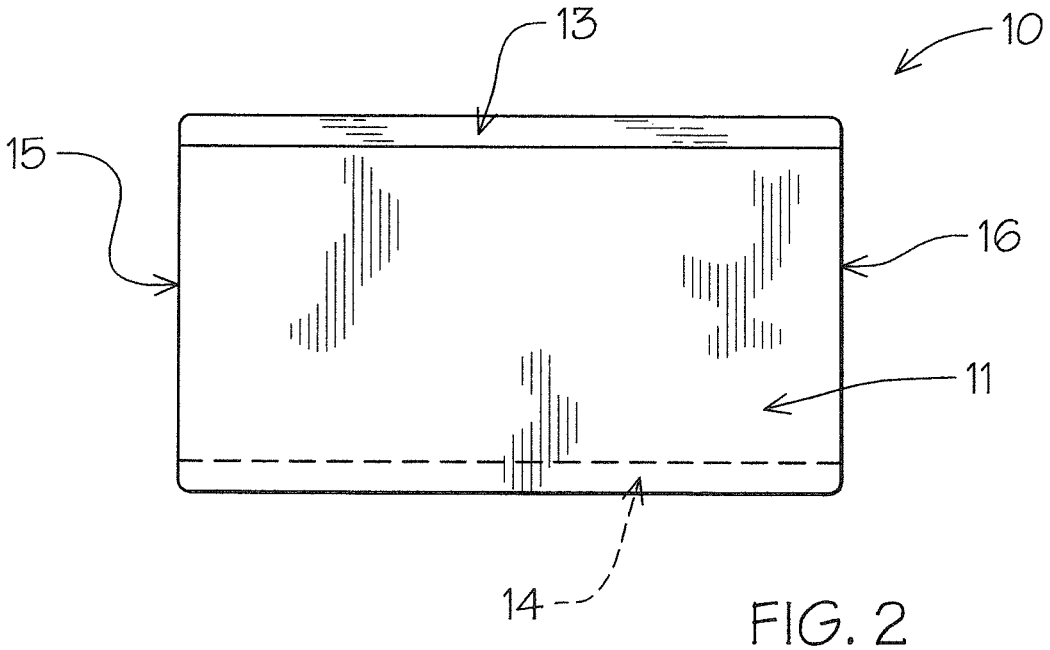
FIG. 2 is a top plan view thereof.

Referring now to FIGS. 1-4 of the drawings, a base forming clay brick 10 of the invention can be seen having a general rectangular configuration with a flat top surface 11 and oppositely disposed spaced parallel flat bottom surface 12. The brick 10 has parallel spaced angularly disposed perspective sidewalls 13 and 14 with corresponding substantially vertical opposing end depending walls 15 and 16.

As such, the clay brick 10 is of a solid monolithic configuration formed, in this example, from compressed and collated naturally occurring clay and blended materials available for specialized sports filed construction, well known within the industry.

Figure 5:
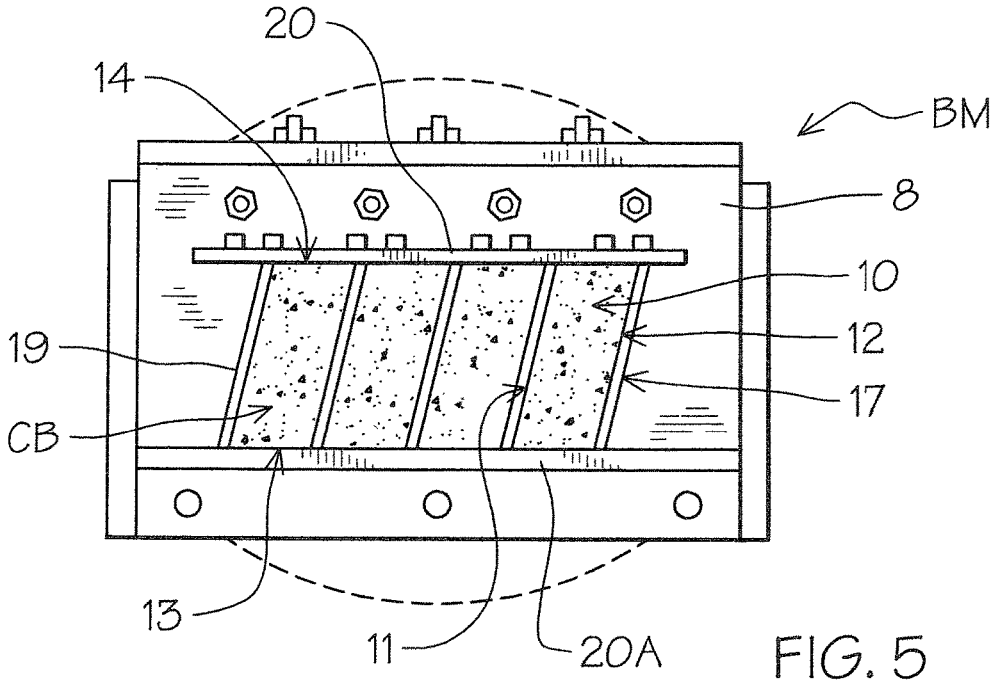
FIG. 5 is a graphic illustration of a brick extruded.

The bricks 10 of the invention are formed, as noted, of a clay blend which is passed through a specialized extrusion dye 17, as seen best in FIG. 5 of the drawings, on a typical brick forming machine BM, well known within the industry. The specialized extrusion dye 17 is illustrated graphically having a support frame 18 with multiple angular inclined partitions 19 with upper and lower perimeter dye plates 20 and 20A. It will be evident that as the clay blend (CB) is extruded there through, that the multiple bricks are formed in a continuous extrusion to be cut at length will indicate the brick 10 of the invention respective top and bottoms 11 and 12 surface by the corresponding partitions 19 and the angular inclined sidewalls 13 and 14 by the angular orientation between the inclined partitions 19 and the upper and lower perimeter dye plates 20 and 20A as hereinbefore described.

Figure 6:
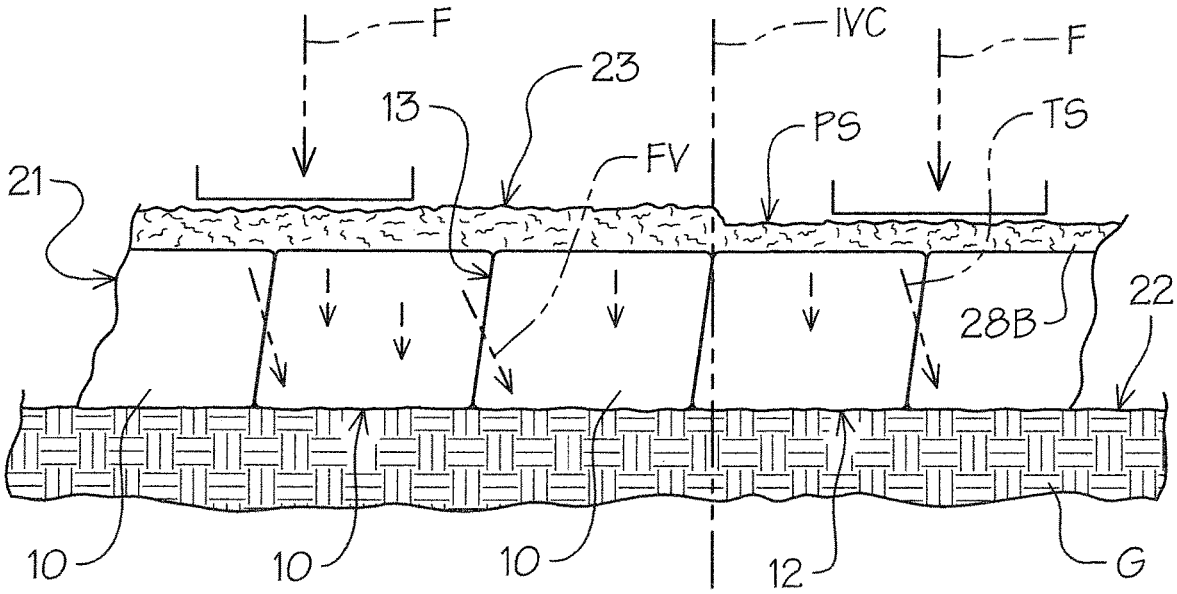
FIG. 6 is a side elevational graphic illustration of multiple bricks of the invention aligned in top to bottom use orientation prior to and during vertical compaction with an over burden layer.

Referring now to FIG. 6 of the drawings, a method step of the invention is illustrated as to the installation of multiple interengaging configured bricks 10 to form a continuous field support clay base 21. The bricks 10 are sequentially laid down, in this one example, on their flat bottom surface 12 in side by side abutting relationship on a prepared ground surface 22. Each of the bricks 10's respective angular inclined sidewalls 13 and 14 which are, as noted, of a ten percent inclination from true vertical represented by the TVC line in FIG. 4 of the drawings. As such, the abutting adjacent brick's sidewalls 14 and 13 define an angular off axis forced transfer surface TS there between. It will be evident that under vertical compression, indicated by the force arrows F of a linear compaction application representation, that an effective force vector FV is thereby applied to the abutting sidewalls 13 and 14 with forced transfer surface TS there between imparting a brick colocation of unification thereto.

In this example, a top compaction layer 23 of a loose clay mixture material from which the bricks 10 are formed is shown overlying the multiple clay bricks 10 top surfaces 11. The top compaction layer 23 is illustrated prior to compaction at 23A and during at 23B. It will be seen that during the applied vertical force F, compression of the surface forming method step will coalesce the interengaged sidewalls 13 and 14 as described interlocking them to one another in a stable integral uniform clay layer assuring a stable construction surface critical to sports field formation features, as noted.

Figure 7:
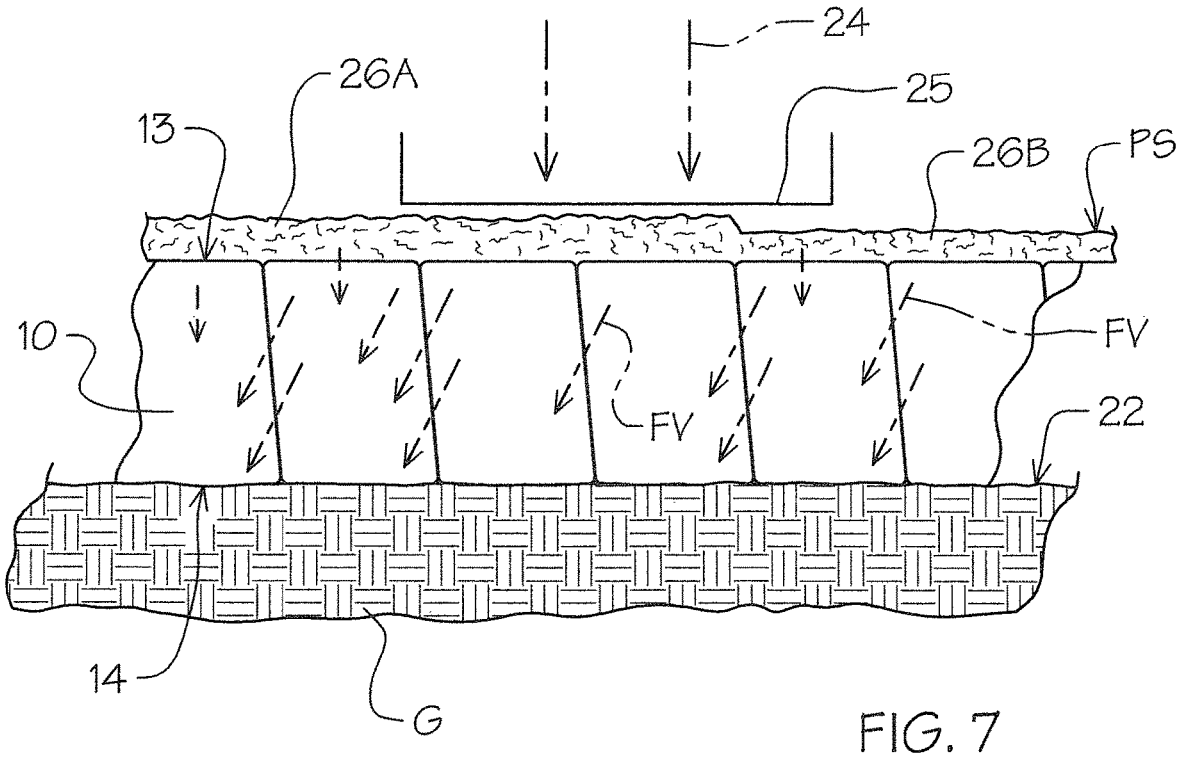
FIG. 7 is an end elevational graphic illustration of upstanding bricks side alignment in use prior to vertical top-dressing compaction.

Referring now to FIG. 7 of the drawings, an alternate clay brick 10 placement orientation can be seen wherein the bricks 10 are positioned on there respective angularly inclined side surfaces 14 on the ground surface 22 in abutting top to bottom relationship. The corresponding abutting top and bottom surfaces 11 and 12 are now in off vertical angular relationship.

It will be evident, therefore, that due to the parallel angular inclination of the respective side surfaces 14 achieved by on side placement that a force vector FV transfer is achieved under vertical compaction induced by force arrow 24 and indicated by linear compaction application representation 25.

The method step formation of a compacted playing surface PS is achieved by a compaction top layer 26A over the exposed horizontally aligned brick side surface 13 indicated a pre-compaction at 26 and during compaction at 26B.

Figure 3:
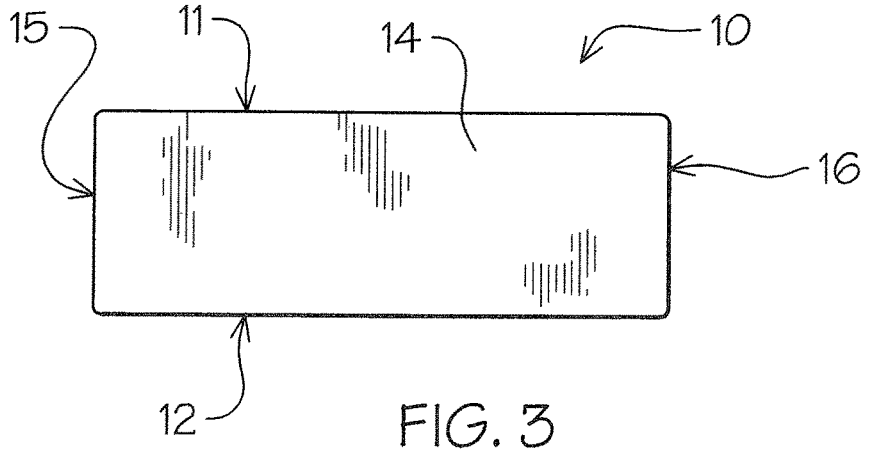
FIG. 3 is a side elevational view thereof.
Figure 4:
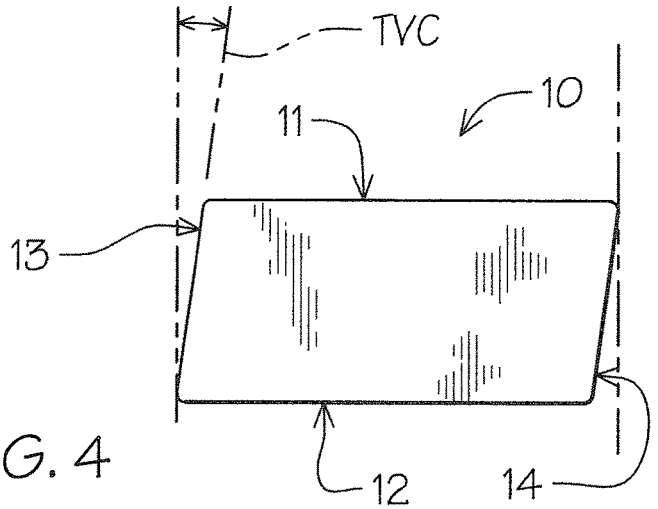
FIG. 4 is an end elevational view thereof.

It will be evident that the side surface placement of the bricks 10 will achieve a thicker base as compared to the hereinbefore described side to side abutting relationships in FIGS. 3 and 6 of the drawings.

Figure 8:
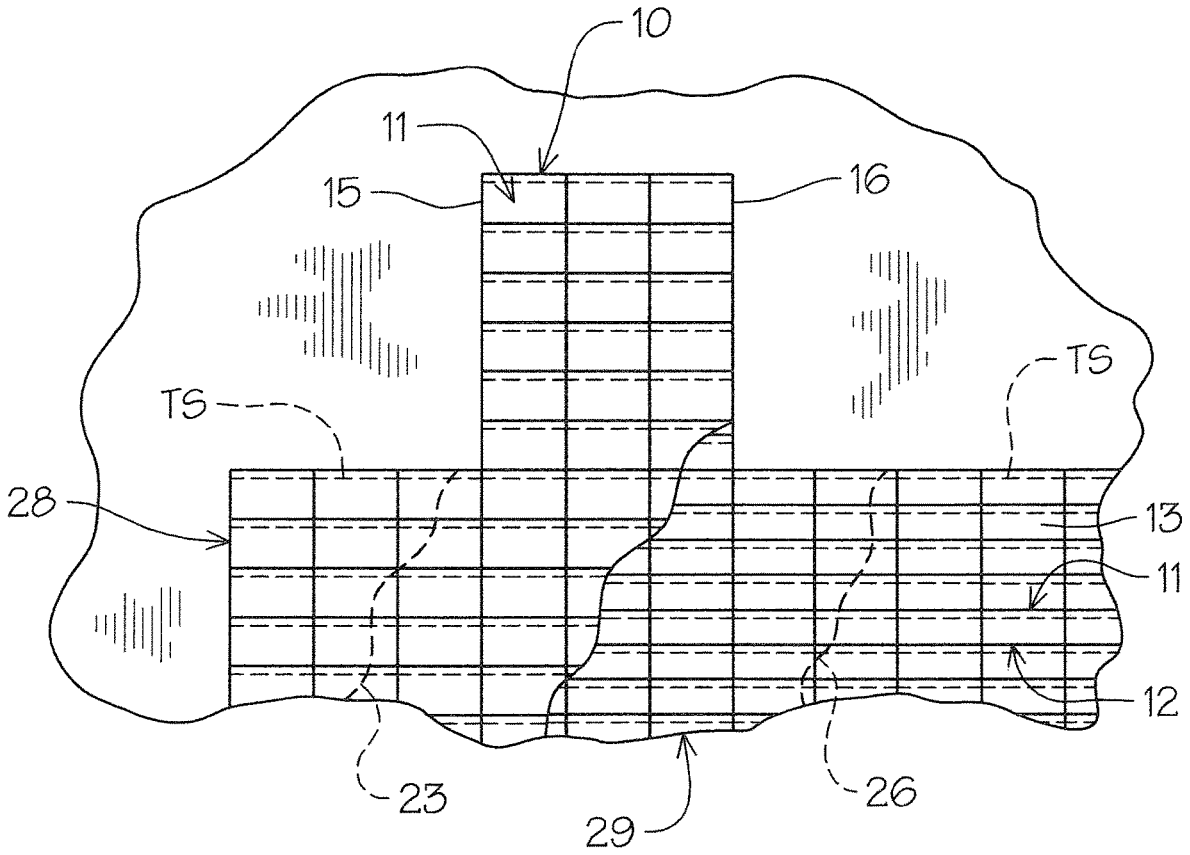
FIG. 8 is a top plan graphic illustration of brick arrangement in use for both vertical and horizontal placement to form a sports field base with overlying material indicated in broken lines.

Referring now to FIG. 8 of the drawings, a typical brick placement arrangement can be seen for both the top to bottom ground engagement at 28 and side to opposing side ground engagement at 29 in the method step constructions. Additionally, the respective representative top layers 23 and 26 are shown in broken lines to provide an overall understanding of a typical application venue which requires the multiple bricks to be placed and then compacted to form a uniform coalesce clay base for the various sports field SF application formations required depending on the venue.

It will thus be seen that a new and novel sports field brick configuration and method step application has been illustrated and described and it will be apparent to those skilled in the art that various changes and modifications may be made thereto without departing from the spirit of the invention. Therefore,

I claim:

1. The method of constructing an athletic field foundation using pre-formed clay bricks comprises, a. forming a clay bricks having flat spaced parallel upper and lower surfaces, spaced parallel transversely angular inclined sidewalls and opposing vertical end walls at right angular relation to said bricks upper and lower surfaces, b. installing a sub-surface layer of clay bricks arranged in abutting relationship to one another, c. installing a surface layer of loose clay compactable material over the sub-surface layer of clay bricks aligned in angular abutting relationship to one another, d. compacting the surface layer of loose clay compactable material and the sub-surface layer of the clay bricks, e. interlocking the sub-surface layer of clay bricks by force vector angular surface to angular surface engagement under loose clay compactable compression for translateral displacement, f. forming a co-mingled continuous monolithic layer of clay bricks by said force vector compaction.

2. The method of claim 1 wherein the clay brick arrangements in abutting relationship step comprises, placing said clay bricks in angular inclined sidewall abutment relationship.

3. The method of claim 1 wherein the clay brick arrangement abutting relationship step further comprises, placing said bricks in upper longitudinal, vertical and horizontal abutting relationship on said athletic field.

4. The method of claim 1 wherein forming clay bricks having flat spaced parallel upper and lower surfaces, spaced parallel transversely angular parallel sidewalls and opposing vertical end walls comprises, compaction extrusion of a clay blend of natural occurring materials through a spaced parallel angular extrusion dye plates.

5. The method of claim 1 wherein the interlocking sub-surface layers of clay bricks by force angular vector surface to surface engagement step comprises, applying vertical directional force to said abutting layers of clay brick by linear compaction application against said brick's upright surfaces.

6. The method of claim 1 wherein forming a co-mingled contiguous monolithic layer of clay bricks from force vector compaction further comprises, tangential force transfer directly between the angular vertical off axis abutting brick surfaces along a force transfer surface there between.

7. The method claim of claim 1 wherein said angular inclined sidewalls of said bricks are in a range of one degrees to 15 degrees off true vertical.

* * * * *